US005743938A

United States Patent [19]

Nishikawa et al.

[11] Patent Number: 5,743,938

[45] Date of Patent: Apr. 28, 1998

[54] METHOD OF DECARBURIZING REFINING MOLTEN STEEL CONTAINING CR

[75] Inventors: Hiroshi Nishikawa; Masaru Washio; Naoki Kikuchi, all of Chiba, Japan

[73] Assignee: Kawasaki Steel Corporation, Kobe, Japan

[21] Appl. No.: 764,438

[22] Filed: Dec. 12, 1996

Related U.S. Application Data

[63] Continuation of Ser. No. 459,271, Jun. 2, 1995.

[30] Foreign Application Priority Data

| | | | |
|---|---|---|---|
| Jun. 6, 1994 | [JP] | Japan | 6-123679 |
| Oct. 5, 1994 | [JP] | Japan | 6-241303 |
| Oct. 5, 1994 | [JP] | Japan | 6-241304 |
| Mar. 31, 1995 | [JP] | Japan | 7-076435 |

[51] Int. Cl.[6] ..... C21C 5/35

[52] U.S. Cl. ..... 75/532; 75/540; 75/546; 75/551; 75/552

[58] Field of Search ..... 75/532, 540, 546, 75/551, 552, 558

[56] References Cited

U.S. PATENT DOCUMENTS

| | | | |
|---|---|---|---|
| 3,307,937 | 3/1967 | Pihlblad et al. | 75/554 |
| 4,426,224 | 1/1984 | Shimme et al. | 75/533 |
| 4,445,933 | 5/1984 | Saito et al. | 75/554 |
| 4,457,777 | 7/1984 | MacGregor et al. | 75/552 |
| 4,517,015 | 5/1985 | Inaba et al. | 75/558 |
| 4,615,730 | 10/1986 | Tommaney | 75/546 |
| 4,990,183 | 2/1991 | Anderson et al. | 75/558 |
| 5,540,753 | 7/1996 | Takano et al. | 75/551 |

FOREIGN PATENT DOCUMENTS

| | | | |
|---|---|---|---|
| 59-177314 | 10/1984 | European Pat. Off. . | |
| 0160374 | 11/1985 | European Pat. Off. . | |
| 0393391 | 10/1990 | European Pat. Off. . | |
| 51-087112 | 7/1976 | Japan . | |
| 52-095502 | 8/1977 | Japan . | |
| 58-096812 | 6/1983 | Japan . | |
| 58-93809 | 6/1983 | Japan | 75/558 |
| 58-193309 | 11/1983 | Japan . | |
| 4-329818 | 11/1992 | Japan . | |

*Primary Examiner*—George Wyszomierski
*Attorney, Agent, or Firm*—Dvorak & Orum

[57] ABSTRACT

A method of decarburizing refining molten steel containing Cr in such a manner that oxygen gas, inert gas or a mixture of inert gas and oxygen gas is blown to the surface of bath of molten steel containing Cr in a refining chamber and to a position below the surface of the steel bath. Inert gas is blown to the surface of the steel bath, and oxygen gas, the inert gas or a mixture of oxygen gas and inert gas is blown below the surface of the steel bath in a portion of or all of an overall period in which the concentration of C in the molten steel is in a range of 1 wt % and 0.05 wt %. Slag and molten steel are stirred so as to cause $Cr_2O_3$ in the slag and C in the molten steel to positively take part in a reaction represented by expression (1) below:

$$Cr_2O_3+3C \rightarrow 2Cr+3CO \quad (1)$$

6 Claims, 7 Drawing Sheets

CHANGE IN TEMPERATURE OF MOLTEN STEEL OCCURRING AFTER $N_2$ HAS BEEN BLOWN FROM UPPER PORTION AT A CONCENTRATION OF C OF 0.20% FOR 5 MINUTES (°C)

METHOD OF DECARBURIZING REFINING MOLTEN STEEL CONTAINING CR

This application is a continuation of application Ser. No. 08/459,271, filed 2 Jun. 1995.

BACKGROUND OF THE INVENTION

1. Field of the Invention

The present invention relates to a method of decarburizing molten steel that contains Cr, including molten stainless steel and, more particularly, to a refining method with which decarbonization of the molten steel containing Cr is performed and which is capable of simultaneously preventing rise in the temperature of the molten steel and increase in the amount of oxidized Cr.

2. Description of Related Art

Generally, when refining of steel containing chrome, such as stainless steel, by decarburizing the same, chrome can be oxidized simultaneously with the decarburization. Therefore, decarburization is excessively interrupted. Accordingly, there arises a desire for molten steel obtainable from resolution in a converter, an AOD(Argon Oxygen Decarbonization) furnace or the like to be subjected to a sufficient decarburizing refining process. Hence, a method has been employed in which oxygen gas, or inert gas or their mixture is in part sprayed to the surface and a portion below the surface of the bath of the steel containing Cr in the furnace.

In the foregoing case, when molten stainless steel is decarburizing, oxidation of Cr in the steel, that is, $Cr+\frac{3}{4}O_2 \rightarrow \frac{1}{2}Cr_2O_3$ takes place simultaneously with the decarburizing reaction $C+\frac{1}{2}O_2 \rightarrow CO$. The amount of oxidized Cr increases along with the fall of the concentration of C in the steel. In particular, if the concentration of C is 1% or lower, the amount of oxidized Cr rapidly increases. The foregoing reaction is affected by a multiplicity of factors, such as the flow rate of oxygen, a state where the molten steel is stirred, and the CO partial pressure in the ambience in the furnace. It is therefore difficult to adjust the degree of the reaction, and thus a large quantity of Cr is changed to slag, causing a so-called Cr loss to take place during oxidization. Because of the same reason, reaction heat generated during oxidization of Cr cannot easily be adjusted. As a result, the temperature of the molten steel when refining has been completed is excessively higher than a desired temperature level. Thus, the operation of refining the stainless steel has not been performed smoothly.

As a technique capable of preventing rise in the temperature of the molten steel, the temperature of the molten steel, that has been raised excessively due to the oxidization of Cr, is generally lowered by any method. For example, a method has been disclosed in Japanese Patent Laid-Open No. 51-87112 in which a coolant comprising small steel pieces for canceling the difference between the temperature of the molten steel measured immediately before the completion of blow refining and the desired temperature of the molten steel, is injected into the furnace through a hopper disposed in the upper portion of the refining furnace. By using the foregoing method, the temperature of the molten steel can be adjusted to a desired level. However, there arises a problem in that local cooling of the molten steel occurring immediately after the injection enhances the oxidization of Cr, and the Cr loss during oxidization is increased undesirably. Moreover, the necessity for the foregoing coolant to be accumulated in the hopper while being formed into a shape so as to be injected increases the cost required to form the coolant. If relatively low cost soft steel is used as the coolant, the small Cr content causes the concentration of Cr in the molten steel to be lowered. As a result, additional adjustment of the components must be performed. Thus, there arises another problem in that the coolant and the amount of FeCr for adjusting the components will enlarge the processing quantity per heat (hereinafter called as "heat size").

To overcome the foregoing problems, a method of controlling the temperature of molten metal bath has been disclosed in Japanese Patent Publication No. 57-1577 which is characterized in that atomized water is transported by inert gas or oxidizing gas so as to be blown into the molten metal bath so that the temperature of the steel bath is controlled. The foregoing method of controlling the temperature of the bath uses decomposition heat generated due to decomposition of water, that is, $H_2O \rightarrow 2H+O$ and the sensible heat of water so as to lower the temperature of the bath. In a case where the foregoing method is adapted to molten stainless steel, a problem however arises in that Cr in the molten steel is oxidized by oxygen discharged during the decomposition and, thus, Cr loss during oxidization increases undesirably. In Japanese Patent Laid-Open No. 58-193309, a refining method has been disclosed which is characterized in that any of coolants, such as $CO_2$, $CaCO_3$, water vapor, water, manganese ore or iron ore or their mixture is mixed with oxygen gas in an outlet portion of a blow refining nozzle so as to be blown into the bath. Although the coolant for use in the foregoing method, discharges oxygen during decomposition, it attains a cooling effect, but no effect of preventing oxidization of Cr. On the contrary, oxidized Cr increases undesirably.

As described above, the temperature of the molten stainless steel may be adjusted during the refining process by a method in which a coolant is injected into the molten steel. Any of the foregoing methods cannot prevent oxidization of Cr; however the methods have suffered from a problem in that oxidization of Cr is enhanced.

As a technique for preventing oxidization of Cr during the operation of refining stainless steel, a method has been disclosed in Japanese Patent Publication No. 2-43803. The foregoing method has the steps of blowing mixture of oxygen gas and inert gas to the surface of the steel bath through a top blowing lance; and, at a small flow rate, introducing inert gas into the steel bath from a position below the surface of the steel bath. Although the foregoing method is capable of effectively preventing oxidization of Cr, only the sensible heat of the inert gas acts as the coolant for the molten steel. Thus, the inert gas, that is introduced into the position below the surface of the steel bath, is too small to cause the sensible heat to satisfactorily cool the molten steel. If slag is introduced into the molten steel by means of the gas blown from an upper position and a phenomenon that slag is drawn into the molten steel takes place, $Cr_2O_3$ in the slag reacts with C in the molten steel so that an endothermic and decomposition reaction $Cr_2O_3+3C \rightarrow 2Cr+3CO$ takes place. In the foregoing case, cooling of the molten steel can be expected. Since the gas blown from an upper position, however, contains oxygen gas, reaction $2Cr+\frac{3}{2}O_2 \rightarrow Cr_2O_3$ takes place simultaneously, and, therefore, the foregoing cooling effect is undesirably canceled. Thus, the foregoing method cannot attain the overall cooling effect.

A so-called out-furnace refining performed in an AOD furnace or the like employs a method disclosed in Japanese Patent Laid-Open No. 4-329818 in which the concentration of C in the molten steel to be injected through the top blowing lance is sufficiently lowered, and then inert gas is blown to the surface of the bath. The foregoing method comprises the steps of sufficiently lowering the concentration of C in the molten steel (specifically, to about 0.03% or lower), and lowering Pco in the furnace by the inert gas blown through the top blowing lance so as to enhance the decarburization. Since the concentration of C in the molten steel can be lowered sufficiently in the foregoing case, reaction of $Cr_2O_3$ in the slag with C in the molten steel, that is, $Cr_2O_3+3C \rightarrow 2Cr+3CO$ cannot easily take place. Therefore, the inert gas, that is blown through the top blowing lance, is not intended to cause the reaction between the slag and the molten steel to take place, but does cause Pco in the furnace to be lowered. The quantity of the inert gas, therefore, is very small such that the quantity is 0.5 times or smaller the total flow rate of the gas, that is blown into the bath. It leads to a fact that the effect of positively stirring the molten steel is unsatisfactory and, therefore, the temperature of the molten steel cannot be adjusted to a desired level.

Another decarburizing refining method has been disclosed in Japanese Patent Publication No. 62-14003 in which ambient diluent gas, which is 20% or more of the total quantity of oxygen gas that is blown into the molten steel, is blown into a gas phase portion in the AOD furnace. However, under the foregoing method involving the step of blowing the gas into the gas phase portion one cannot stir the molten steel and the slag. Thus, the temperature of the molten steel cannot be adjusted. What is worse, since the foregoing method is intended to lower Pco in the furnace similarly to the method disclosed in Japanese Patent Laid-Open No. 4-329818, the $Cr_2O_3$ cannot be decomposed by C in the molten steel.

A method of refining molten steel containing Cr has been disclosed in Japanese Patent Publication No. 1-35887 which is characterized in that a top blowing lance is used to blow inert gas onto the steel bath or into the furnace from an upper position so as to refine the molten steel containing Cr. The foregoing method is a method of a type comprising the steps of decarburizing C in the molten steel to a predetermined level, and effectively preventing absorption of N from the air. The foregoing method, therefore, is not a method of reducing Cr in the molten steel by means of C and of adjusting the temperature. That is, the main object of the foregoing method is, similar to that of the method disclosed in Japanese Patent Laid-Open No. 4-329818, that is, to lower Pco or $P_{N2}$ in the furnace. As a result, the ratio of the gas to be blown from an upper position and the gas to be blown from the bottom portion is, as can be understood from its embodiment, very small such that the ratio is not higher than 0.56. Thus, the slag and the molten steel cannot be stirred, and $Cr_2O_3$ cannot be decomposed by C in the molten steel.

As described above, the conventional technology of decarburizing refining of molten steel containing Cr, including molten stainless steel, has not disclosed a method that is capable of simultaneously realized prevention of Cr loss during oxidization and adjustment of the temperature of the molten steel.

SUMMARY OF THE INVENTION

Accordingly, an object of the present invention is to provide a method of decarburizing refining molten stainless steel or molten steel containing Cr which is capable of simultaneously preventing rise in the temperature of the molten steel and Cr loss during oxidization, and in which carbon in the steel is used efficiently so as to decrease the quantity of the reducing agent required in the reducing process.

In order to achieve the foregoing objects, the inventor of the present invention has directed attention to positive reduction of $Cr_2O_3$ in the slag with carbon in the steel during the blow process, and as a result, the present invention was conceived.

According to one aspect of the present invention, there is provided a method of decarburizing refining molten steel containing Cr in such a manner that oxygen gas, inert gas or a mixture gas of inert gas and oxygen gas is blown to the surface of bath of molten steel containing Cr accommodated in a refining chamber and to a position below the surface of the steel bath, the method of decarburizing refining molten steel containing Cr comprising the steps of:

blowing only the inert gas to the surface of the steel bath; and blowing the oxygen gas, the inert gas or the mixture gas of the oxygen gas and the inert gas to a position below the surface of the steel bath in a portion of or all of an overall period in which the concentration of C in the molten steel containing Cr is in a range not more than 1 wt % and as well as not less than 0.05 wt % so that slag and molten steel are stirred to cause $Cr_2O_3$ in the slag and C in the molten steel to positively take part in a reaction represented by expression (1) below:

$$Cr_2O_3+3C \rightarrow 2Cr+3CO \quad (1)$$

According to another aspect of the present invention, there is provided a method of continuously performing the foregoing decarburizing refining process by adding a carbon source into the refining chamber in the early stage of the decarburizing refining process; blowing oxygen gas to the surface of the bath of molten steel containing Cr and to a position below the surface of the steel bath to refine by decarburizing the molten steel containing Cr.

Other and further objects, features and advantages of the invention will be appear more fully from the following description and claims.

DESCRIPTION OF THE PREFERRED EMBODIMENTS

The inventors of the present invention have paid attention to cause $Cr_2O_3$ in the slag to be positively reduced by C in the steel during the blow refining process and they studied this to develop a method that is capable of simultaneously preventing rise in the temperature of the molten steel and Cr loss during oxidization.

According to the present invention, when refining by decarburizing molten steel containing Cr in such a manner that oxygen gas, inert gas or mixture gas of inert gas and oxygen gas is blown to the surface of bath of molten steel containing Cr accommodated in a refining chamber and to a position below the surface of the steel bath, only the inert gas is blown to the surface of the steel bath, and oxygen gas, inert gas or the mixture gas of the oxygen gas and the inert gas is blown to a position below the surface of the steel bath in a portion of or all of an overall period in which the concentration of C in the molten steel containing Cr is in a range not more than 1 wt % and not less than 0.05 wt %.

Therefore, slag and metal can be stirred sufficiently in the refining chamber, and the produced oxides or slag are drastically drawn into the molten steel so that $Cr_2O_3$ in the slag is reduced by carbon in the molten steel. As a result, Cr loss by oxidization can be prevented, as well as the rise in the temperature of the molten steel.

Figure 1:
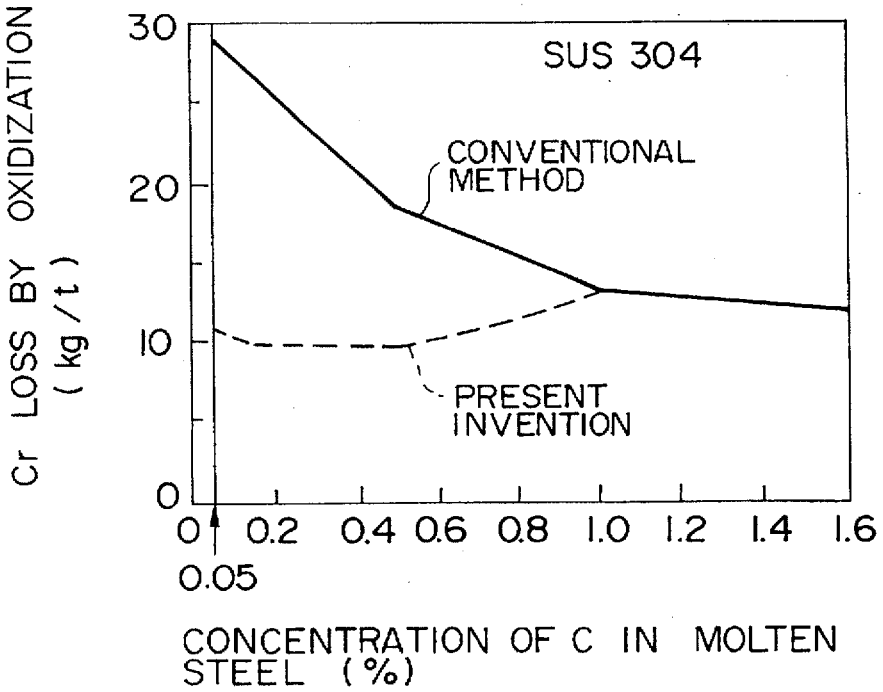
FIG. 1 is a graph showing change in the quantity of Cr loss by oxidization occurring due to change in the concentration of C in the molten steel during the blow refining process.

FIG. 1 is a graph showing the results of the investigation of the relationship between the quantity of Cr loss in the molten steel by oxidization and the concentration of C in the molten steel obtained by blow refining SUS304 in a converter of a type in which blowing from an upper portion and that from a bottom portion are performed. In the conventional method, the results of which are shown in FIG. 1, a mixture of oxygen gas and inert gas is continuously blown to the surface of the steel bath and a position below the surface of the steel bath if the concentration of C in the molten steel including Cr is higher than 1 wt % and not lower than 0.05 wt %. As contrasted with this, the present invention has an arrangement wherein only the inert gas is blown to the surface of the steel bath and oxygen gas or inert gas or their mixture is blown to the position below the surface of the steel bath.

As can be understood from FIG. 1, if the concentration of C in the molten steel is 1.0% or lower, the quantity of Cr loss by oxidization is rapidly increased. It has been found that it is preferable that the inert gas be blown onto the surface of the bath when the concentration of C in the molten steel has been made to be 1% or lower. If the concentration of C in the molten steel is higher than 1%, it can be considered that $Cr_2O_3$ in the slag is too small to attain the effect of preventing the Cr loss by oxidization and to satisfactorily lower the temperature. If the concentration of C in the molten steel is too low, the decomposition of $Cr_2O_3$ does not take place. Accordingly, the concentration of C in the molten steel required to decompose $Cr_2O_3$ is determined to be 0.05% or higher.

If a slag fluxing agent, for example, fluorspar or ballast, is injected when the inert gas is blown to the surface of the bath from an upper position, the slag can further easily be mixed with the molten steel. Thus, the reduction of $Cr_2O_3$ can further be enhanced.

When molten steel containing Cr is refined by decarburizing by using a top and bottom blown converter, a considerably large quantity of gas must be blown to the surface of the steel bath to cause the slag existing on the surface of the steel bath to be drawn into the bath.

Accordingly, the inventor of the present invention carried out water model tests to investigate the relationship between the flow rate of inert gas to be blown to the surface of the steel bath and that of gas to be blown into a position below the surface of the steel bath. As a result, the inventor of the present invention estimated that the flow rate of gas to be blown from an upper portion must be 0.7 times or more than that of gas to be blown to the position below the surface of the steel bath.

Figure 2:
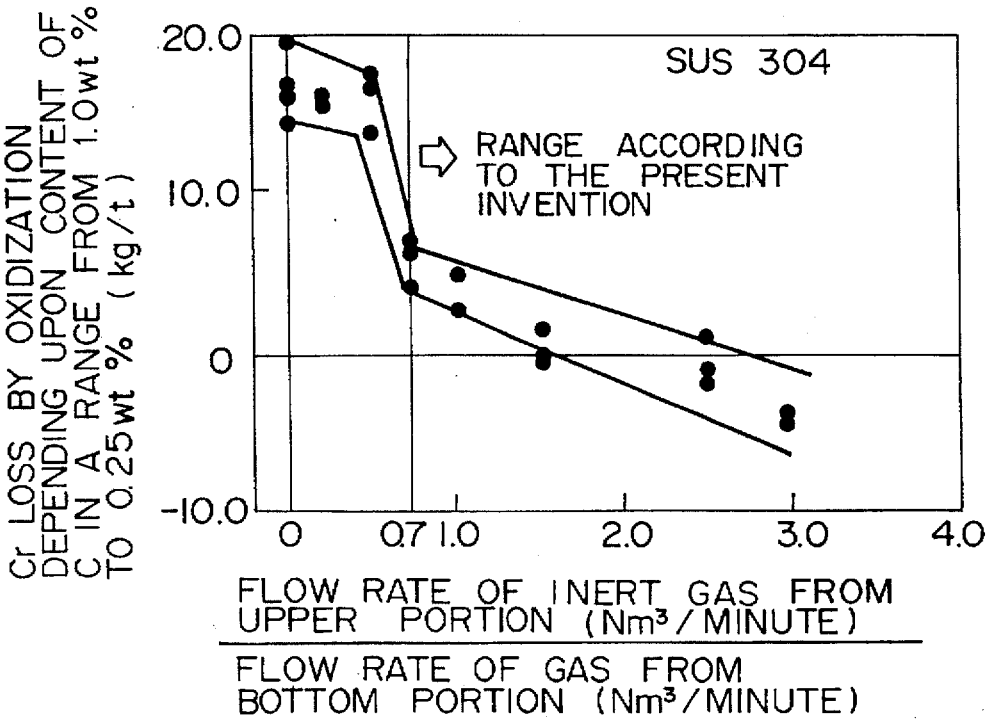
FIG. 2 is a graph showing the relationship between the quantity of the Cr loss by oxidization and the quantity of gas to be blown from an upper portion and a bottom portion in a case where the concentration of C in the molten steel is in a range from 1.0 wt % to 0.25 wt %.

To prove the foregoing estimation, a dozen or so charges of SUS304 were blow refined in the top and bottom blown converter, each charge being 110 tons. The results are shown in FIG. 2. FIG. 2 is a graph showing the relationship between the quantity of Cr loss by oxidization (kg/t) and the ratio of the flow rate ($Nm^3$/min) of the inert gas (nitrogen) blown from an upper portion with respect to the flow rate ($Nm^3$/min) of the gas (mixture gas of oxygen and nitrogen) blown from a bottom portion. As can be seen from FIG. 2, the Cr loss by oxidization can significantly be prevented if the flow rate of the inert gas blown from an upper portion is 0.7 times or larger than the flow rate of gas blown from the bottom portion.

By blowing the inert gas to the surface of the bath in a quantity which is 0.7 times or larger the flow rate of gas to be blown from a position below the surface of the steel bath, if the concentration of C in the molten steel is any value in the range not higher than 1 wt % and not lower than 0.05 wt %, the decomposition endothermic reaction of $Cr_2O_3$ can take place. By appropriately determining the flow rate of the inert gas to be blown onto the surface of the bath and the range of the concentration of C in the molten steel when the inert gas is blown at the foregoing flow rate, the degree of fall of the temperature of the molten steel and the quantity of the Cr loss by oxidization can be adjusted.

As a result of investigation of methods of adjusting the quantity of Cr loss by oxidization and the degree of fall of the temperature of the molten steel, it was found that the adjustment can be made by controlling the motion of the surface of the molten steel resulting from the gas blown to a position below the surface of the steel bath and the motion of the surface of the steel bath resulting from the inert gas to be blown to the surface of the steel bath to cause the slag on the surface of the steel bath to be efficiently drawn into the molten steel.

Several methods for performing the adjustment were found.

When only the inert gas is blown to the surface of the steel bath and oxygen gas and/or inert gas is blown to a position below the surface of the steel bath in the range of the concentration of C in the molten steel being not higher than 1 wt % and not lower than 0.05 wt %, the depth L mm of depression of the surface of the steel bath realized by the inert gas blown to the surface of the steel bath and the height ΔH mm of the surface of the steel bath raised by the injected gas from a position below the surface of the steel bath have a relationship represented by the following expression:

$$L/\Delta H \geqq 0.05 \quad (2)$$

where the depression depth L of the surface of steel bath can be represented by the following expression (3) (at pp.94, "Iron Metallurgy Reaction Industry" written by Segawa, 1977, Nikkan Kogyo Shinbun):

$$L = L_h \cdot \exp(-0.78\ h/L_h) \quad (3)$$

$$L_h = 63.0\ (Q_T/n_T d)^{2/3} \quad (4)$$

where h: height (mm) of the top blowing lance for blowing the inert gas from the surface of steel bath $Q_T$: flow rate ($Nm^3$/hr) of insert gas to be blown to the surface of the steel bath $n_T$: number of ports in the top blowing lance d: average diameter (mm) of the ports in the top blowing lance The height ΔH of the raised surface of the steel bath can be represented by the following expression (5) (Kato's Dissertation, 1989, Tohoku University and Kawatetsu Giho 15 (1983), pp.100, Nakanishi et al.):

$$\Delta H = 52.0\ (Q_B/n_B W)^{2/3} \quad (5)$$

where $Q_B$: flow rate ($Nm^3$/hr) of oxygen gas or mixture gas of oxygen gas and inert gas to be blown to a position below the surface of the steel bath $n_B$: number of tuyeres for gas to be blown to a position below the surface of the steel bath W: weight of molten steel (ton)

100 tons of SUS304 were placed in a top and bottom blown converter to change L/ΔH at the time of performing blow refining. The blowing operation was performed by a method in which the gas to be blown from a bottom portion was mixture of oxygen gas and $N_2$ gas and a method in which the blow was only $N_2$ gas. In the former case, the gas to be blown from a bottom portion comprised oxygen gas, the flow rate of which was 0.33 $Nm^3$/t·minute and $N_2$ gas, the flow rate of which was 0.77 $Nm^3$/t·minute. Furthermore, the gas to be blown from an upper portion comprised $N_2$ after the concentration of C in the molten steel had been lowered to 0.25%. After the concentration of C in the molten steel was brought to 0.05%, blowing was interrupted. Then, the quantity of Cr loss by oxidization and change in the temperature of the molten steel per 1 $Nm^3$/t of the $N_2$ gas were examined. In the latter case, after the concentration of C in the molten steel had been brought to 0.25%, blowing of the oxygen gas from the upper position was interrupted. Then, $N_2$ gas was blown from the bottom portion at a flow rate of 0.15 $Nm^3$/t·minute and $N_2$ gas was blown from the upper portion at a flow rate of 0.5 to 2.5 $Nm^3$/t·minute for 5 minutes. Then, the quantity of Cr loss by oxidization and change in the temperature of molten steel per 1 $Nm^3$/t·minute were examined.

Figure 3:
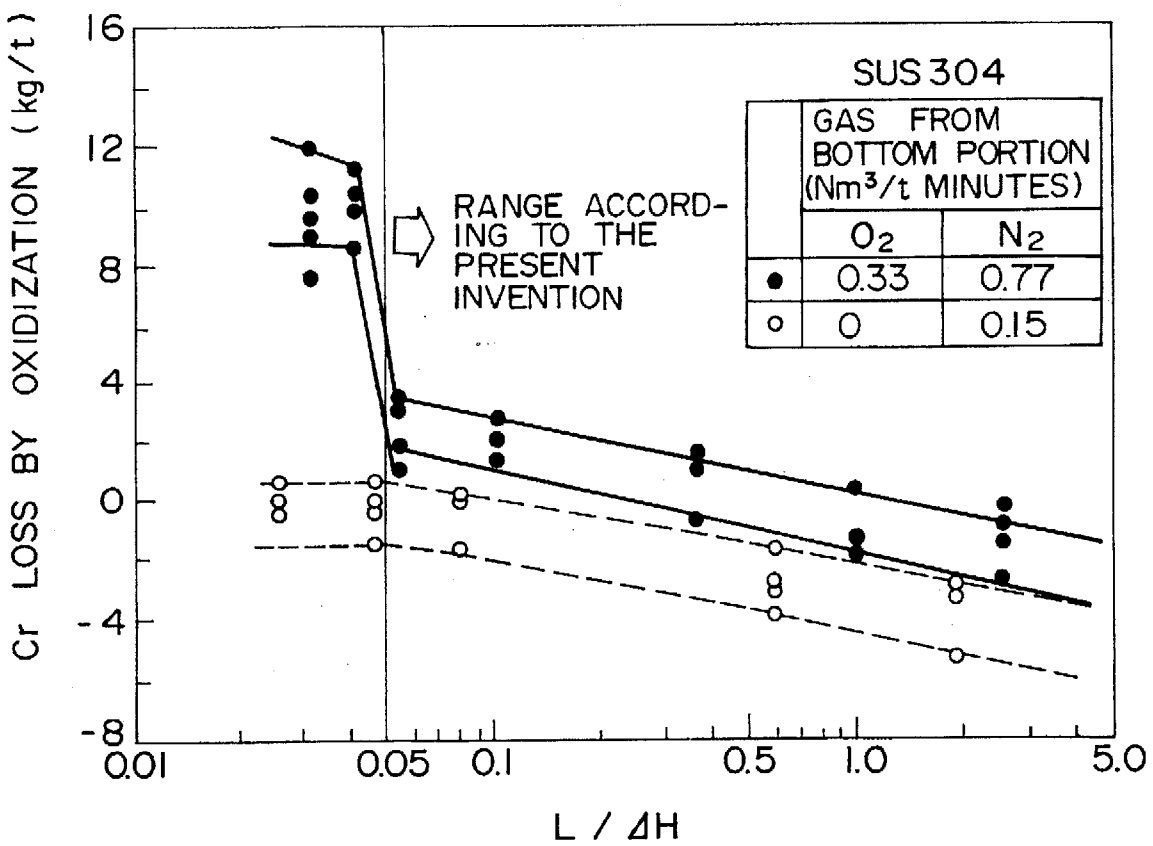
FIG. 3 is a graph showing the relationship between the quantity of Cr loss by oxidization and L/ΔH.
Figure 4:
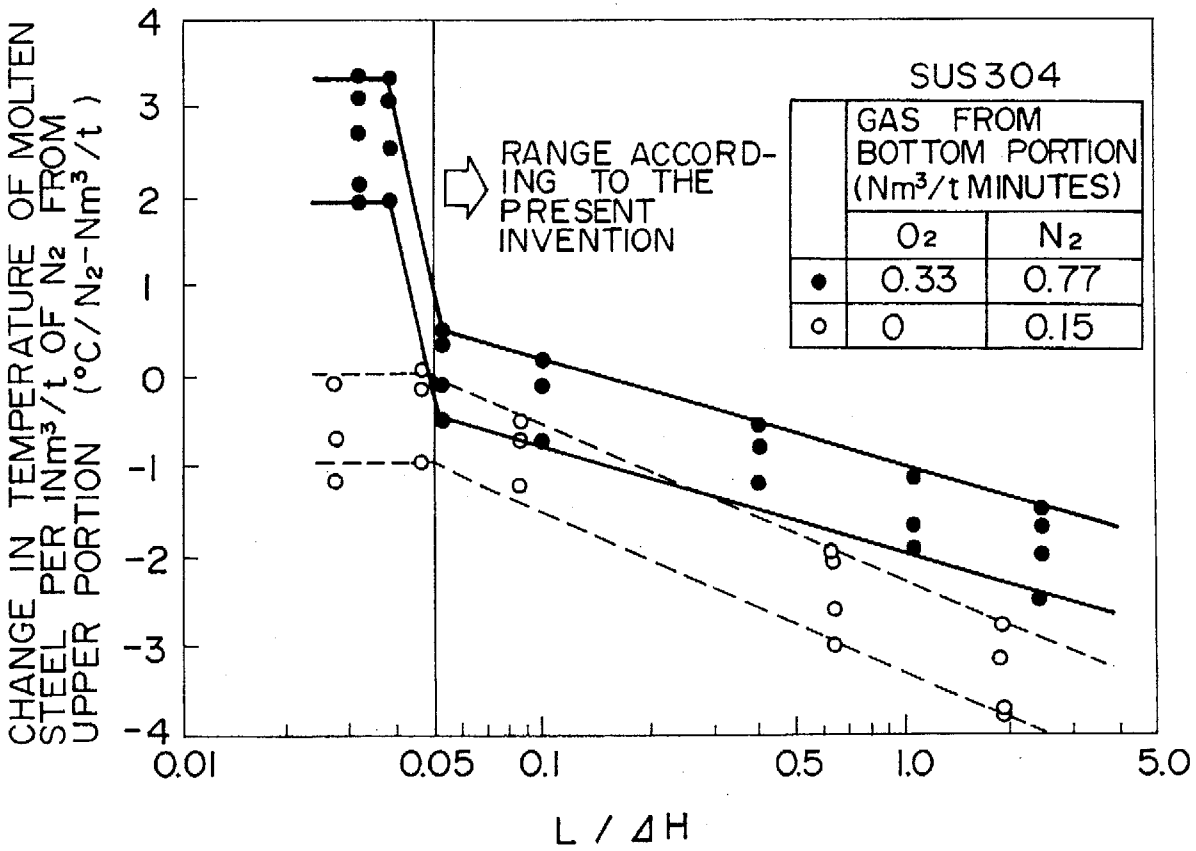
FIG. 4 is a graph showing the relationship between change in the temperature of molten steel per 1 $Nm^3/t$ of nitrogen gas blown from the upper portion and L/ΔH.

The results are shown in FIGS. 3 and 4. It was found that, if L/ΔH≧0.05, reduction in the quantity of Cr loss by oxidization and lowering of the temperature of the molten steel could simultaneously be realized. Therefore, the condition L/ΔH≧0.05 is a required factor for the present invention. By determining appropriate L/ΔH, the molten steel could be cooled to a desired level.

Figure 5:
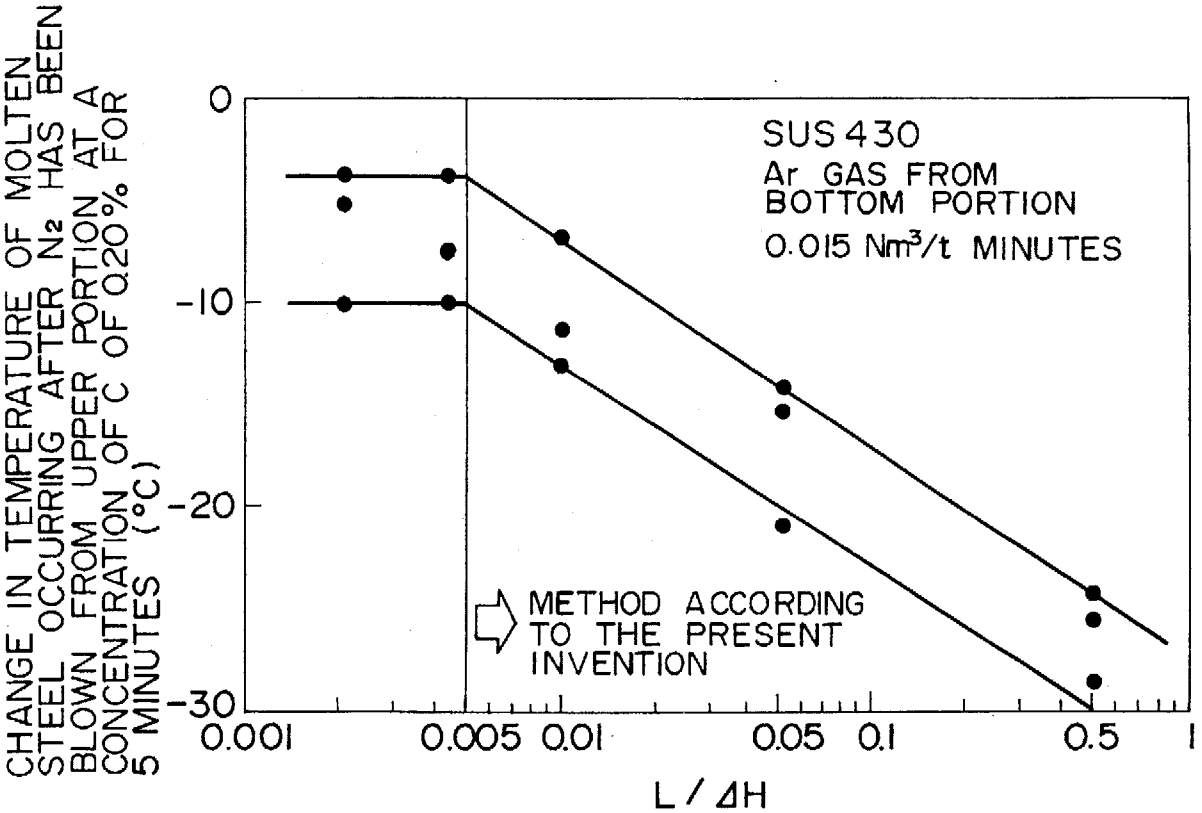
FIG. 5 is a graph showing the relationship between change in the temperature of molten steel and L/ΔH when nitrogen gas is blown from the upper portion for 5 minutes from the moment when the concentration of C in the molten steel is 0.20 wt %.
Figure 6:
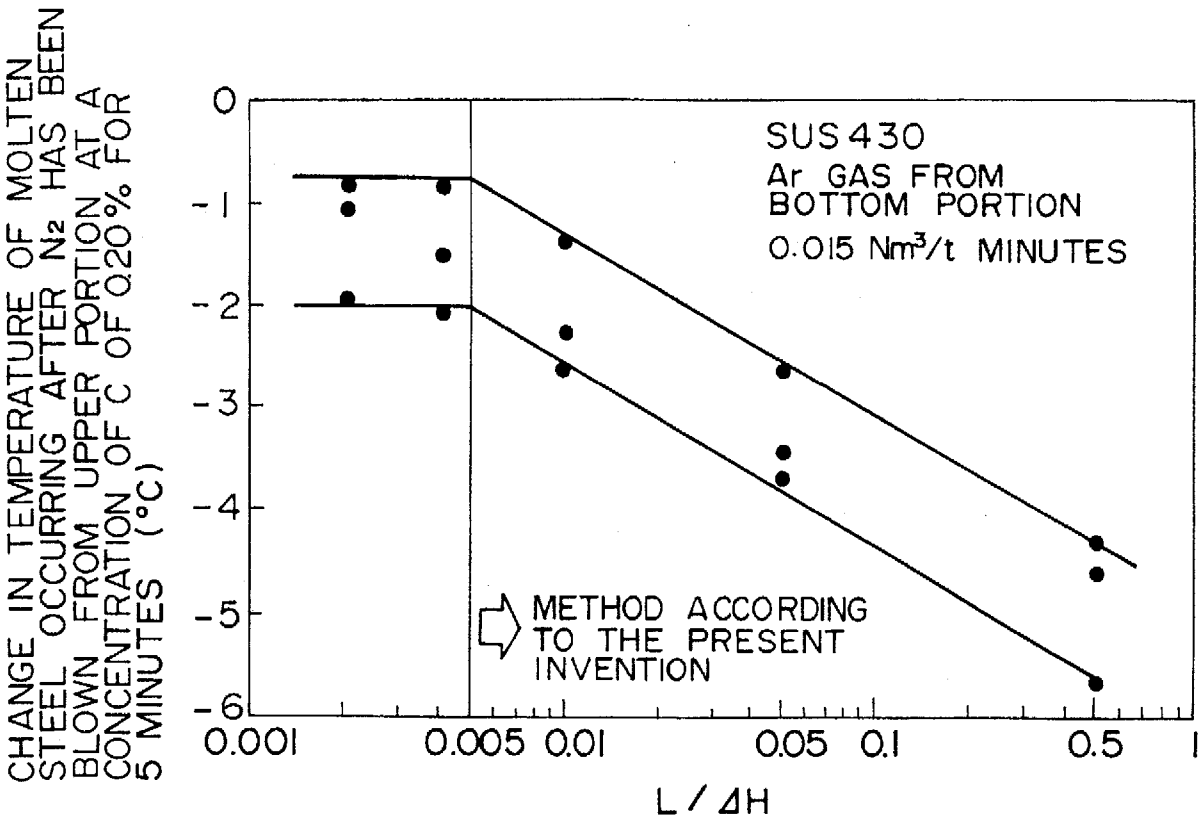
FIG. 6 is a graph showing the relationship between the quantity of Cr loss during oxidization and L/ΔH when the nitrogen gas is sprayed from the upper portion for 5 minutes from the moment when the concentration of C in the molten steel is 0.20 wt %.

Then, whether or not the method according to the present invention could be adapted to vacuum refining. 60 tons of SUS430 were refined by decarburizing in a top and bottom blown converter. Then, the molten steel, with a concentration of C of 0.20%, was discharged into a ladle. The ladle inevitably received the slag at a rate of 30 kg/t from the converter. Since the received slag had not been reduced by FeSi or the like in the converter, it contained 44% of $Cr_2O_3$. The ladle was introduced into a vacuum chamber, and then Ar gas was blown from the bottom portion of the ladle as the gas to be blown from the bottom portion at a flow rate of 0.015 $Nm^3$t·minute. Simultaneously, $N_2$ gas was blown from a top blowing lance at a flow rate of 0.015 to 0.33 $Nm^3$/t·minute for 5 minutes, so that the molten steel and slag were stirred. The Cr loss by oxidization and change in the temperature of the molten steel are shown in FIGS. 5 and 6. As can be understood from FIGS. 5 and 6, if L/ΔH≧0.005, then reduction in the Cr loss by oxidization and lowering of the temperature of the molten steel can simultaneously be obtained.

As a result, the required factor for the present invention adapted to vacuum refining was determined to be L/ΔH≧0.005. In the foregoing case, non-reduced or slightly reduced slag in a large quantity may positively be shifted from the converter into the ladle with the slag that inevitably exists. The present invention may be performed after acid has been supplied as is employed in VOD(Vucuum Oxygen Decarbonization) vacuum refining. Another process may be employed in which the present invention is performed, the temperature is adjusted to a desired level, and acid blow is again introduced.

Furthermore, the inventors of the present invention performed blow refining in which nitrogen gas was used as the gas to be blown from an upper portion in a range of the concentration of C in the molten steel containing Cr from 1.0 wt % to 0.05 wt % in such a manner that the flow rate and the height of the lance from the surface of the bath were varied. As a result, the quantity of Cr loss by oxidization was changed due to the foregoing change. Since the flow rate of the gas to be supplied is a constant rate, Pco (CO partial pressure) is not substantially changed by changing the height of the lance. In accordance from a fact that lowering of the height of the lance reduced the quantity of Cr loss by oxidization, the inventors of the present invention discovered that the decarburizing effect realized by the gas blown from an upper portion cannot be attained due to fall in Pco but it is realized by the stirring energy of the gas blown from an upper portion.

Figure 7:
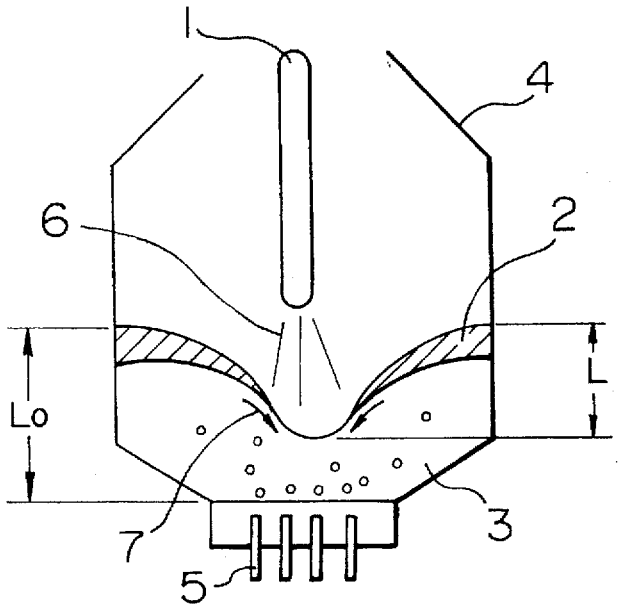
FIG. 7 shows an example of a state where a decarburizing refining method according to the present invention is adapted in a 5-ton test converter and the depth of the depression of the surface of the steel bath.

FIG. 7 is a diagram showing a state where the method of refining by decarburizing molten steel containing Cr according to the present invention is being embodied by using a top and bottom blown converter. As shown in FIG. 7, when inert gas 6 is blown from a top blowing lance 1, the surface of molten steel 3 in a refining chamber 4 is made concave. As a result, a flow 7 consisting of slag 2 and metal 3 adjacent to the concave portion move downwards. Note that reference numeral 5 represents tuyeres for gas to be blown from the bottom portion. Symbol L represents the depth of the depressed surface of the steel bath represented by expression (5) and obtained due to blowing of the inert gas from the surface of the steel bath, $L_0$ represents the depth of molten steel in the refining chamber.

The inventors of the present invention found that, if $L_0$ and L have the relationship represented by expression (6), then the Cr loss by oxidization can be reduced.

$L/L_0 \geqq 0.2$ (6)

Figure 8:
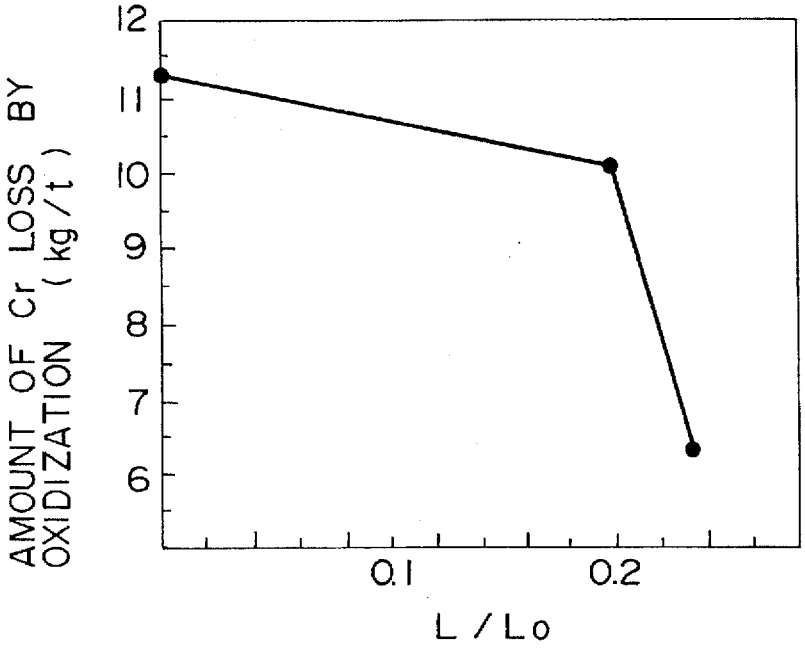
FIG. 8 is a graph showing the relationship between the stirring power density of the inert gas blown from an upper portion and the quantity of the Cr loss by oxidization.

FIG. 8 shows the relationship between $L/L_0$ and the quantity of Cr loss by oxidization (kg/t) when a dozen and so charges of SUS304 are subjected to blowing in a top and bottom blown converter, the charge being 110 tons. As can be understood from FIG. 8, the Cr loss by oxidization can rapidly be reduced when $L/L_0=0.2$.

Moreover, said symbol L which represents the depth of the depressed surface of the steel bath represented by expression (5) may be obtained by actual measurement.

As described above, the present invention is structured on the basis of the method of refining by decarburizing molten steel containing Cr in such a manner that oxygen gas, inert gas or mixture gas of inert gas and oxygen gas is blown to the surface of bath of molten steel containing Cr accommodated in a refining chamber and to a position below the surface of the steel bath. The method of refining by decarburizing molten steel containing Cr comprises the steps of: blowing only the inert gas to the surface of the steel bath; and blowing the oxygen gas, the inert gas or the mixture gas of the oxygen gas and the inert gas to a position below the surface of the steel bath in a portion of or all of an overall period in which the concentration of C in the molten steel containing Cr is in a range not more than 1 wt % and not less than 0.05 wt %. Rise in the temperature of the molten steel and prevention of Cr loss by oxidization can simultaneously be realized by adequately combining the following methods: a method in which the inert gas in a quantity, which is 0.7 times or more the quantity of the gas to be blown to a position below the surface of the steel bath, is blown to the surface of the steel bath; a method in which the relationship between the depth L mm of depression of the surface of the steel bath produced by the inert gas blown to the surface of the steel bath and the height $\Delta H$ mm of the steel bath raised by the gas blown to the position below the surface of the steel bath is controlled to satisfy $L/\Delta H \geqq 0.05$; a method in which the relationship between the depth L mm of depression of the surface of the steel bath and depth $L_0$ mm of the steel bath satisfies $L/L_0 \geqq 0.2$.

Note that the step for refining by decarburizing molten steel containing Cr in such a manner that oxygen gas, inert gas or mixture gas of inert gas and oxygen gas is blown to the surface of bath of molten steel containing Cr accommodated in a refining chamber and to a position below the surface of the steel bath and the step of blowing only the inert gas to the surface of the steel bath in a range of not more than 1 wt % and not less than 0.05 wt % and blowing the oxygen gas, the inert gas or the mixture gas of the oxygen gas and the inert gas to a position below the surface of the steel bath may be carried out in one refining chamber or after shifting to another refining chamber.

For example, a top and bottom blown converter, a bottom blown converter, a n AOD furnace and a VOD furnace may advantageously be combined.

According to the present invention, a carbon source may be added to the decarburizing furnace in the early stage of the refining by decarburizing process to reduce the Cr loss by oxidization that involves the early stage of the decarburizing refining process. The addition of the carbon source is done separately from the addition of carbon added for the purpose of compensating for the quantity of carbon in the molten steel. For example, if carbon is added to molten steel obtained by resolving scrap and containing carbon, which is unsaturated at the time of starting refining, carbon in a quantity larger than the required quantity is added. The carbon source may be added into the molten steel or to the surface of the molten steel. Note that the early stage of the refining by decarburizing process is defined to be a decarburizing refining process in a state where the concentration of carbon in the molten steel containing Cr is 1% or higher.

It is preferable that the carbon source be added in a period from start of the decarburizing process to the moment that the temperature of the molten steel reaches 1,500° C. in such a manner that carbon in the molten steel maintains the saturation concentration of carbon. The carbon source may be added at the start of the refining process or may be added intermittently or time sequentially continuously after the process has been started.

If a technique is additionally employed, which is arranged in such a manner that the foregoing decarburizing refining process is performed until the concentration of carbon in the molten steel containing Cr reaches 1%; while continuing blowing from a bottom portion, only the inert gas is used as the gas to be blown from an upper portion so as to be blown to the overall or a partial region in a state where the surface of the molten steel is being stirred strongly; and decarburizing is performed to a very low carbon region, a reaction between the slag and metal in the surface portion of the molten steel will enhance the reduction of the oxidized Cr in the slag. Thus, rise in the temperature can be prevented.

EXAMPLES

Example 1

By using molten coarse stainless steel having a heat size and the chemical composition shown in Table 1, examples were conducted. In Example 1, molten steel having the heat size shown in Table 1 and a fluxing agent were injected into a top and bottom blown converter. The gas to be supplied from an upper portion was blown from a lance, the height of which was 3.0 m from the surface of the steel bath, while the gas to be supplied from the bottom portion was blown through nozzles disposed on the bottom of the furnace. During blow refining, the temperature of the molten steel, the concentration of C in the molten steel and the concentration of Cr were measured by using a sub-lance, the measurement being repeated three times, that is, when the concentration of C in the molten steel was 1.0% and 0.25% and when blowing was stopped (immediately before reduction). After blowing had been interrupted, FeSi (content of Si: 75 wt %) was added to the molten steel to reduce it in a usual manner.

The results of comparison between the gas blow pattern (the type of the gas used at each blowing step and change in the flow rate) according to the present invention and that of Conventional Method 1 were shown in Table 2. As can be understood from Table 2, in Example 1 according to the present invention, oxygen was blown to the surface of the steel bath until the concentration of C in the molten steel reached 0.6. Then, blow of the oxygen gas from the upper portion was interrupted and nitrogen, which is the inert gas, was blown from the upper portion at a flow rate which was substantially 0.71 times that of the gas (total quantity of oxygen gas and nitrogen gas) to be blown from the bottom portion. On the other hand, the foregoing gas flow rate was not employed by Conventional Method 1. After blow had been interrupted, FeSi was used in a quantity of 21.70 Kg/t in the Conventional Method 1 and in a quantity of 13.60 Kg/t in Example 1. Thus, reduction in the units of the quantity of the reducing agent was established. The chemical components after the reduction had been performed are shown in Table 1.

As for the results of the refining process, as shown in Table 3, prevention of rise in the temperature of the molten steel and Cr loss by oxidization were established according to Example 1 as compared with Conventional Method 1.

TABLE 1

| | | HEAT SIZE | CHEMICAL COMPOSITION (wt %) | | | | | | |
|---|---|---|---|---|---|---|---|---|---|
| | | (TON) | C | Si | Mn | P | S | Cr | Ni |
| BEFORE REFINING | CONVENTIONAL METHOD 1 | 105 | 5.6 | — | 1.02 | 0.033 | 0.016 | 17.32 | 7.88 |
| | EXAMPLE 1 | 103 | 5.9 | — | 1.04 | 0.031 | 0.018 | 17.31 | 7.63 |
| AFTER REFINING | CONVENTIONAL METHOD 1 | — | 0.055 | 0.22 | 1.10 | 0.036 | 0.003 | 18.35 | 8.32 |
| | EXAMPLE 1 | — | 0.058 | 0.26 | 1.11 | 0.033 | 0.003 | 18.39 | 8.11 |

TABLE 2

| | | C in Molten Steel (wt %) | | | | |
|---|---|---|---|---|---|---|
| | | >1.0 | 1.0≧ >0.60 | 0.60≧ >0.45 | 0.45≧ | Reduction Period |
| Conventional Method 1 | | | | | | |
| Gas Supplied from Upper Portion ($Nm^3$/Minute) | $O_2$ | 200 | 66 | 0 | 0 | 0 |
| | $N_2$ | 0 | 0 | 0 | 0 | 0 |
| Gas Supplied from Bottom ($Nm^3$/Minute) | $O_2$ | 70 | 67 | 33 | 33 | 0 |
| | $N_2$ | 18 | 31 | 77 | 77 | 70 |
| Example 1 | | | | | | |
| Gas Supplied from Upper Portion ($Nm^3$/Minute) | $O_2$ | 200 | 66 | 0 | 0 | 0 |
| | $N_2$ | 0 | 0 | 70 | 80 | 0 |
| Gas Supplied from Bottom ($Nm^3$/Minute) | $O_2$ | 78 | 67 | 67 | 33 | 0 |
| | $N_2$ | 18 | 31 | 31 | 77 | 70 |

TABLE 3

| | Sub-lance | | | |
|---|---|---|---|---|
| | First Step (C: 1.0%) | Second Step (C: 0.25%) | Third Step (Interruption of spraying) | Desired Value when spraying is stopped |
| Conventional Method 1 | | | | |
| C in Molten Steel (%) | 0.98 | 0.22 | 0.055 | 0.055 |
| Temperature of Molten Steel (°C.) | 1679 | 1738 | 1768 | 1725 |
| Cr in Molten Steel (%) | 16.87 | 16.10 | 15.21 | 16.35 or more |
| Cr loss (kg/t) | 14.8 | 22.5 | 31.4 | 20.0 or less |
| Example 1 | | | | |
| C in Molten Steel (%) | 0.90 | 0.26 | 0.058 | 0.055 |
| Temperature of Molten Steel (°C.) | 1677 | 1715 | 1730 | 1725 |
| Cr in Molten Steel (%) | 17.25 | 16.97 | 16.68 | 16.39 or more |
| Cr loss (kg/t) | 11.0 | 14.2 | 17.1 | 20.0 or less |

(*Allowable temperature range is desired level ± 5° C.)

Example 2

Decarburization refining operation in accordance with the present invention was conducted by using a crude molten stainless steel having a heat size and a chemical composition as shown in Table 4. At the same time, an operation was executed in accordance with a conventional technique within the range corresponding to that of the invention of this application. Conditions of these operations are inclusively shown in Table 5. Table 5 also shows the value of the ratio L/ΔH for each case. These test operations were carried out by using a bottom-blown converter as a refining vessel. Thus, gases were blown into the converter from a nozzle opening in the bottom of the converter. During the blowing, the temperature of the molten steel, the concentration of C in the molten steel and the concentration of Cr in the same were measured three times: namely, when the concentration of C was 1.0%, when the concentration of C was 0.25% and when the blowing was ceased (immediately before the reduction). These measured values were used for the purpose of evaluation of the operation achievement.

Table 6 shows the gas blowing pattern in accordance with the method 2 of the invention, in comparison with that of the conventional method 2. As shown in Table 6, both in the method 2 of the invention and the conventional method 2, top blowing with nitrogen gas at a blowing rate which is 0.32 times as large that of the bottom blowing gas, was commenced when the concentration of C in the steel was lowered to 1.0 wt % or less. The value L/ΔH at the time of commencement of the top blowing was 0.04 in the conventional method and 1.58 to 1.59 in the method 2 of the present invention.

As a result, the reducing FeSi unit in the method 2 of the present invention was 5.2 kg/t which was much smaller than 12.1 kg/t which was observed in the conventional method 2. Chemical compositions after the reduction and the results of refining are shown in Table 7. It will be seen that the method 2 of the present invention, as are the cases of other examples, is effective in preventing temperature rise of the molten steel, as well as suppression of Cr loss by oxidation.

TABLE 4

| | Heat Size | Chemical composition (wt %) | | | | | | |
|---|---|---|---|---|---|---|---|---|
| | (ton) | C | Si | Mn | P | S | Cr | Ni |
| Before refining | | | | | | | | |
| Conventional method 2 | 110 | 5.5 | — | 0.95 | 0.030 | 0.018 | 16.18 | 5.50 |
| Example 2 | 110 | 5.6 | — | 0.96 | 0.029 | 0.019 | 16.00 | 5.10 |
| After refining | | | | | | | | |
| Conventional method 2 | — | 0.061 | 0.61 | 1.10 | 0.034 | 0.003 | 18.15 | 8.21 |
| Example 2 | — | 0.051 | 0.62 | 1.13 | 0.032 | 0.003 | 18.10 | 8.25 |

TABLE 5

| Items | Conventional Method 2 | | | Example 2 | | |
|---|---|---|---|---|---|---|
| Refining vessel | Bottom blowing converter (Only inert gas for top blowing) | | | Bottom blowing converter (Only inert gas for top blowing) | | |
| Heat size (ton) | 110 | | | 110 | | |
| Top blowing lance | | | | | | |
| Height (mm) | 3,500 | | | 2,000 | | |
| Number of nozzles | 9 | | | 3 | | |
| Mean nozzle dia (mm) | 15 | | | 15 | | |
| Number of bottom blowing tuyeres | 10 | | | 10 | | |
| $Q_I$ ($Nm_3$/min.) | 80 | | | 80 | | |
| $Q_B$ ($Nm_3$/min.) | | | | | | |
| $O_2$ | 125 | 83 | 41 | 125 | 83 | 41 |
| $N_2$ + Ar | 125 | 167 | 210 | 125 | 167 | 210 |
| L (mm) | | 12.4 | | | 471.2 | |
| Δ H (mm) | 296.8 | 296.8 | 297.6 | 296.8 | 296.8 | 297.6 |
| L/Δ H | 0.04 | 0.04 | 0.04 | 1.59 | 1.59 | 1.58 |

TABLE 6

| | | C in Molten Steel (wt %) | | | | |
|---|---|---|---|---|---|---|
| | | >1.0 | 1.0≧ >0.60 | 0.60≧ >0.45 | 0.45≧ | Reduction Period |
| Conventional Method 4 | | | | | | |
| Gas supplied from bottom portion ($Nm^3$/minute) | $O_2$ | 0 | 0 | 0 | 0 | 0 |
| | $N_2$ | 0 | 80 | 80 | 80 | 0 |
| Gas supplied from upper portion ($Nm^3$/minute) | $O_2$ | 200 | 125 | 83 | 41 | 0 |
| | $N_2$ | 50 | 125 | 167 | 210 | 250 |
| Example 4 | | | | | | |
| Gas supplied from bottom portion ($Nm^3$/minute) | $O_2$ | 0 | 0 | 0 | 0 | 0 |
| | $N_2$ | 0 | 80 | 80 | 80 | 0 |
| Gas supplied from upper portion ($Nm^3$/minute) | $O_2$ | 200 | 125 | 83 | 41 | 0 |
| | $N_2$ | 50 | 125 | 167 | 210 | 250 |

TABLE 7

| | Sub-lance | | | |
|---|---|---|---|---|
| | First Step (C: 1.0%) | Second Step (C: 0.25%) | Third Step (Interruption of spraying) | Desired value when spraying is stopped. |
| Conventional Method 2 | | | | |
| C in Molten Steel (%) | 0.95 | 0.23 | 0.061 | 0.055 |
| Temperature of Molten Steel (°C.) | 1670 | 1760 | 1770 | 1700 |
| Cr in Molten Steel (%) | 17.41 | 16.53 | 16.05 | 17.05 or more |
| Cr loss (kg/t) | 7.4 | 16.2 | 21.0 | 11.0 or less |
| Example 2 | | | | |
| C in Molten Steel (%) | 0.98 | 0.26 | 0.051 | 0.055 |
| Temperature of Molten Steel (°C.) | 1725 | 1721 | 1698 | 1700 |

TABLE 7-continued

| | Sub-lance | | | |
|---|---|---|---|---|
| | First Step (C: 1.0%) | Second Step (C: 0.25%) | Third Step (Interruption of spraying) | Desired value when spraying is stopped. |
| Cr in Molten Steel (%) | 17.35 | 17.21 | 17.25 | 17.00 or more |
| Cr loss (kg/t) | 7.5 | 8.9 | 8.5 | 11.0 or less |

Example 3

SUS 430 steel was charged in a top and bottom blown converter and subjected to decarburization refining. The steel was then teemed to a ladle without being reduced with FeSi or the like. The ladle was placed in a vacuum tank in which vacuum decarburization refining operation was conducted under a reduced pressure of 1 torr or lower. The composition of the steel before this treatment is shown in Table 8, and the refining conditions of the method of the present invention are shown in Table 9 in comparison with those of the conventional method. Whole part of the slag (about 40 kg/t) generated in the top and bottom blown converter had been shifted to the ladle. The $Cr_2O_3$ content in the slag was about 45% both in the conventional method and the method of the invention. The gas blowing pattern in accordance with the method 3 of the invention is shown in Table 10 in comparison with that of the conventional method. It will be seen that, in the method 3 of the present invention, top blowing nitrogen gas alone was commenced simultaneously with the start of the treatment without executing supply of acid, and was continued for 5 minutes so as to stir the slag and the molten steel. The conventional method 3 was executed under the same condition. The ratio of the flow rate of the top blown nitrogen gas to the flow rate of the bottom blown argon gas was 0.66 in the method 3 of the present invention, whereas, in the conventional method 3, the ratio was 0.55. The value of L/ΔH was 0.14 in the method 3 of the invention and $1.4\times10^{-5}$ in the conventional method 3.

The results are shown in Table 11. As will be seen from this Table, the conventional method 3 could not lower the molten steel temperature, due to the fact that decarburization did not proceed to the expected extent after the stop of the top blowing with nitrogen gas. Therefore, decarburization was conducted by blowing oxygen gas, followed by an adjustment of molten steel temperature by using a coolant. In this case, however, the Cr loss by oxidation was enhanced and the FeSi unit for reduction was as large as 15.2 kg/t. In contrast, in the case of the method 3 of the present invention, decarburization proceeded with the top-blown nitrogen gas alone, achieving a concentration of C falling within the target range, while lowering the temperature of the molten steel. Consequently, the method 3 of the present invention could lower the reducing FeSi unit down to 5.5 kg/t which is as small as about ⅓ that required by the conventional method 3.

Chemical compositions of the molten steels after the reduction are shown in Table 8.

TABLE 8

| | Heat Size (ton) | Chemical composition (wt %) C | Si | Mn | P | S | Cr | Ni |
|---|---|---|---|---|---|---|---|---|
| Before refining | | | | | | | | |
| Conventional method 3 | 61 | 0.20 | — | 0.58 | 0.030 | 0.025 | 15.80 | — |
| Example 3 | 60 | 0.21 | — | 0.57 | 0.029 | 0.022 | 15.85 | — |
| Conventional method 3 | — | 0.062 | 0.21 | 0.59 | 0.030 | 0.002 | 16.31 | — |
| Example 3 | — | 0.060 | 0.22 | 0.60 | 0.030 | 0.003 | 16.29 | — |

TABLE 9

| Items | Conventional Methos 2 | Example 3 |
|---|---|---|
| Refined vessel | Vacuum refining | Vacuum refining |
| Heat size (ton) | 61 | 60 |
| Top blowing lance | | |
| Height (mm) | 800 | 600 |
| Number of nozzles | 4 | 1 |
| Mean nozzle dia (mm) | 10 | 12.5 |
| Number of bottom blowing tuyeres | 3 | 3 |
| $Q_I$ ($Nm_2$/min.) | 0.5 | 0.6 |
| $Q_B$ ($Nm_2$/min.) | | |
| $O_2$ | 0 | 0 |
| $N_2$ + Ar | 0.9 | 0.9 |
| L (mm) | $3.2 \times 10^{-4}$ | 3.2 |
| Δ H (mm) | 23.3 | 23.3 |
| L/Δ H | $1.4 \times 10^{-5}$ | 0.14 |

TABLE 10

| | | Blowing period from the start of the treatment (minutes) >5 | 5.0≧ >10 | 10≧ >15 | 15≧ | Reduction Period |
|---|---|---|---|---|---|---|
| Conventional method 3 | | | | | | |
| Gas supplied from upper portion ($Nm^3$/minute) | $O_2$ | 0 | 20 | 0 | 0 | 0 |
| | $N_2$ | 0.5 | 0 | 0 | 0 | 0 |
| Gas supplied from bottom portion | $O_2$ | 0 | 0 | 0 | 0 | 0 |
| | $N_2$ | 0.9 | 0.9 | 0.9 | 0.9 | 0.9 |

TABLE 10-continued

| | | Blowing period from the start of the treatment (minutes) >5 | 5.0≧ >10 | 10≧ >15 | 15≧ | Reduction Period |
|---|---|---|---|---|---|---|
| ($Nm^3$/minute) | | | | | | |
| Example 3 | | | | | | |
| Gas supplied from upper portion ($Nm^3$/minute) | $O_2$ | 0 | 0 | 0 | 0 | 0 |
| | $N_2$ | 0.6 | 0 | 0 | 0 | 0 |
| Gas supplied from bottom portion ($Nm^3$/minute) | $O_2$ | 0 | 0 | 0 | 0 | 0 |
| | $N_2$ | 0.9 | 0.9 | 0.9 | 0.9 | 0.9 |

TABLE 11

| | Sub-lance First Step (C: 1.0%) | Second Step (C: 0.25%) | Third Step (Interruption of spraying) | Desired Value when spraying is stopped |
|---|---|---|---|---|
| Conventional Method 3 | | | | |
| C in Molten Steel (%) | 0.20 | 0.15 | 0.062 | 0.055 |
| Temperature of Molten Steel (°C.) | 1678 | 1670 | 1630 | 1620 |
| Cr in Molten Steel | 14.66 | 14.80 | 13.50 | 16.20 or |

TABLE 11-continued

| | Sub-lance | | | |
|---|---|---|---|---|
| | First Step (C: 1.0%) | Second Step (C: 0.25%) | Third Step (Interruption of spraying) | Desired Value when spraying is stopped |
| (%) | | | | more |
| Cr loss (kg/t) | 16.5 | 15.1 | 28.1 | 15.0 or less |
| Example 3 | | | | |
| C in Molten Steel (%) | 0.21 | 0.060 | 0.056 | 0.55 |
| Temperature of Molten Steel (°C.) | 1680 | 1665 | 1621 | 1620 |
| Cr in Molten Steel (%) | 14.83 | 15.26 | 15.27 | 16.20 or more |
| Cr loss (kg/t) | 14.6 | 10.3 | 10.2 | 15.0 or less |

(*Allowable temperature range is desired level ± 5° C.)

Example 4

A structure for blowing gas from an upper portion of a 5-ton test furnace was provided, and the method of decarburizing refining molten steel containing Cr was performed according to the present invention.

Initially, a blow gun was set to a carbon concentration of 1.0 wt % in a usual oxygen refining process, in which blowing is performed from an upper portion and a bottom portion. Then, the method according to the present invention w as employed. The operation conditions were as shown in Table 12.

In this example, in only two regions, that is, in a region in which the concentration of C was 0.1 to 0.3 and in a region in which the same was 0.5 to 1.0, gas was blown from the bottom portion and nitrogen gas was blown from the upper portion to the surface of the steel bath in such a manner that the depth ($L/L_0$) of the depressed portion in the central portion of the surface of the steel bath was 0.2. In other carbon concentration regions, the gas shown in Table 12 was blown from the bottom portion. As a result, the Cr loss during oxidization could be reduced in an average value of 4.95 kg/t as compared with that realized in the conventional method, as shown in Table 13. The conventional refining by decarburizing method is a method in which no nitrogen gas was blown from the upper portion in the foregoing carbon concentration region.

Since the temperature was lowered due to blowing of the nitrogen gas and the degree of lowering was in proportion to the period of blowing, determination of the blowing timing and period to correspond to the temperature of the molten steel will permit the decarburizing refining process to be performed while adjusting the desired temperature. Thus, the Cr loss by oxidization can be reduced. The final concentration of carbon in the molten steel was 0.1 wt % in this example.

Example 5

Experiments were performed in the 5-ton test converter similarly to Example 4. Also the test conditions were the same as those shown in Table 12.

Figure 9:
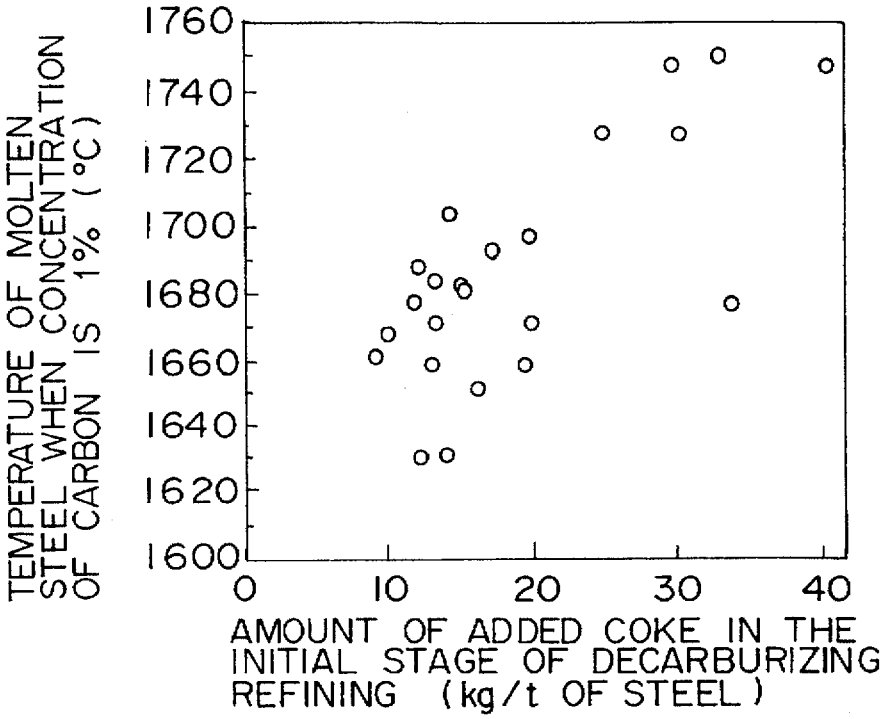
FIG. 9 is a graph showing the relationship between the quantity of coke added in the early stage of the decarburizing refining process and the quantity of the Cr loss during oxidization occurring in a period from start of the decarburizing refining process to the moment that the concentration of C reaches 1.

The relationship between the quantity of coke to be added in the early stage of the decarburizing refining process and the quantity of Cr loss by oxidization in a period from the start of the decarburizing refining process to a moment the concentration of C reached 1 is shown in FIG. 9. It can be seen that the quantity of Cr loss during oxidization decreased in inverse proportion to the quantity of added coke.

TABLE 12

| Test condition | |
|---|---|
| Reaction chamber | 5-ton Test Furnace |
| Weight of molten steel | 4.5 t |
| Chrome concentration range | Concentration of Cr = 15 to 16.5 |
| Concentration of carbon blown from upper portion | Concentration of Cr = 0.1 to 0.2 |
| Temperature at which blowing of nitrogen from upper portion starts | 1953 to 2103K |
| Gas supplied from upper portion | $N_2$ |
| Flow rate of gas supplied from upper portion | 1.3 to 2.5 $Nm^3/t/min$ |
| Height of top blowing lance | 2.5 to 3.3 m |
| Gas supplied from bottom portion | $O_2$, $N_2$, Pr |
| Flow rate of gas supplied from bottom portion | 0.7 to 1.1 $Nm^3/t/min$ |

TABLE 13

| | Present Invention | | Conventional Invention | |
|---|---|---|---|---|
| Range of C. (%) in Molten Steel when nitrogen is blown from upper portion | 0.3–0.1 | 1.0–0.5 | No nitrogen supplied from upper portion | |
| Unites of acid supply source from bottom portion ($Nm^3$) | 3.2 | 4.5 | 3.3 | 4.3 |
| Set ($L/L_0$) | 0.5 | 0.2 | 0 | 0 |
| Change in Temperature of Molten Steel (°C.) | −35 | −12 | 1 | 10 |
| Cr loss during Oxidization (kg/t) | 5 | 7 | 11 | 13 |

Figure 10:
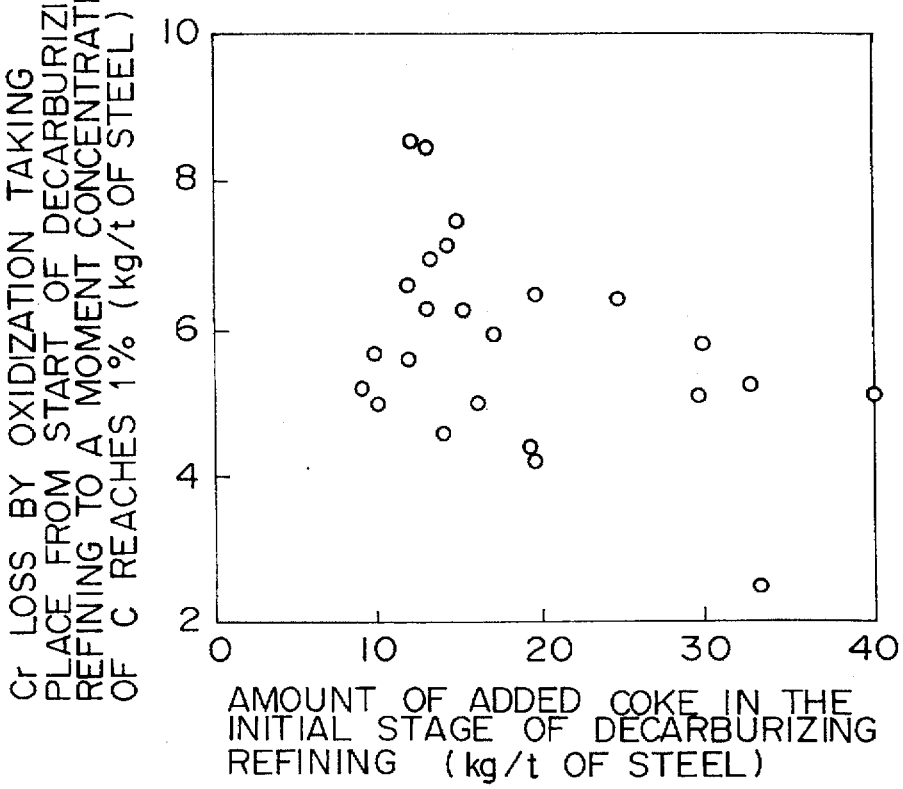
FIG. 10 is a graph showing the relationship between the coke added in the early stage of the decarburizing refining process and the temperature of the molten steel when the concentration of C is 1.

FIG. 10 shows the quantity of coke added in the early stage of the decarburizing refining process, the quantity of added coke at the temperature of the molten steel when the concentration of C was 1, and the temperature of the molten steel when the concentration of C was 1 under the same conditions. The increase in the quantity of the added coke enlarged the quantity of the oxidation of carbon until the concentration of C was 1, and the temperature of the molten steel was raised. The source of carbon to be added is determined to correspond to the operation conditions in such a manner that the foregoing temperature is made to be an appropriate level, for example, 1680° C. to 1720° C.

Thus, reduction in the Cr loss by oxidization in the early stage and rise in the temperature of the molten steel when the concentration of C was 1, resulted in improvement in the decarburizing efficiency. As a result, the Cr loss by oxidization can be reduced. Thus, the units of the Si source required to reduce the molten steel after blowing has been completed can be reduced, and, therefore, the refining cost can be reduced. FIG. 10 shows the results of this example in which the relationship between the concentration of carbon at the completion of blowing and the units of the Si source for reducing the molten steel in the 5-ton test converter.

As described above, according to the present invention, in the region of the concentration of C from 1.0 to 0.1 in which the Cr loss by oxidization is increased and the temperature is raised rapidly in the process for decarburizing refining molten steel containing chrome, the inert gas is blown to the surface of the steel bath through a top blowing lance. Thus, slag and metal can be stirred strongly, chrome oxide which is allowed to float and slag were blown into the molten steel to enhance the reduction due to carbon in the molten $Cr_2O_3$ in the slag. As a result, Cr loss by oxidization can be prevented.

Since the foregoing reduction reaction is an endothermic reaction, the rise in the temperature can be prevented during the foregoing reaction. As a result, melting loss of refractories can be prevented, and quick rise in the temperature can be realized from the early stage of the blow refining process.

The present invention is structured in such a manner that the carbon source is added to the molten bath to a supersaturation level in the early stage of the decarburizing refining process to reduce $Cr_2O_3$ in the slag produced due to Cr loss by oxidization with carbon. Thus, the Cr loss by oxidization can be reduced. Furthermore, since the quantity of decarburization can be increased to a specific carbon concentration, the temperature of the molten steel can be raised. Because of the foregoing two factors, the Cr loss by oxidization can be reduced in the process for decarburizing refining molten steel containing Cr.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A method of refining by decarburizing a bath of molten steel contained within a refining chamber, said molten steel including a slag layer and having an initial temperature within an allowable temperature range, and containing a concentration level Cr, said slag layer containing a concentration of $Cr_2O_3$ said refining proceeding in such a manner that one of an oxygen gas, an inert gas and a mixture of said inert gas and oxygen gas is blown to a bottom of said steel bath, said method comprising the steps of:

adding a carbon source to the refining chamber in an early stage of the decarburizing refining process;

blowing oxygen gas to the surface of the bath of molten steel and to a bottom of the steel bath in order to decarburize the molten steel;

blowing only the inert gas to the surface of the steel bath; and blowing one of the oxygen gas, the inert gas and a mixture of the oxygen gas and the inert gas to a bottom of the steel bath during one of a portion of and all of a decarburization period in which the concentration of C in the molten steel containing Cr is in a range of 1 wt % to 0.05 wt % so that the slag and the molten steel are stirred within said chamber to cause said $Cr_2O_3$ in the slag and the C in the molten steel to positively take part in a reduction reaction represented by an expression wherein:

$$Cr_2O_3+3C \rightarrow 2Cr+3CO.$$

2. The method as claimed in claim 1, wherein a flow rate of the inert gas blown to said surface of said steel bath is at least 0.7 times the flow rate of the gas blown to the bottom of the steel bath.

3. The method as claimed in claim 1, wherein the inert gas blown to the surface of the steel bath creates a centralized depression in said bath, said depression having a measurable depth L relative to said bath surface prior to depressing and wherein the gas blown to the bottom of the steel bath causes said bath to vertically rise within said chamber from a resting height to another height, said rise in height having a measurable extent ΔH, wherein said depth L and said rise in height ΔH are represented by an expression wherein:

$$L/\Delta H \geqq 0.05.$$

4. The method as claimed in claim 1, wherein the inert gas blown to the surface of the steel bath during one of a portion of and all of a decarburizing period creates a centralized depression in said bath, said depression having a measurable depth L relative to said bath surface prior to depressing, and said bath having a measurable depth $L_0$ prior to blowing of said gas, said gas being blown in a manner wherein the depression depth L and said depth $L_0$ satisfies an expression wherein:

$$L/L_0 \geqq 0.2.$$

5. The method as claimed in claim 1, wherein said carbon source is added in a period from a start of the decarburizing refining process to a moment the temperature of the molten steel reaches 1,500° C. in a manner such that said carbon in the molten steel maintains a saturation concentration of carbon.

6. The method of refining as claimed in claim 1, wherein said simultaneous decarburizing of said molten steel and reducing said reduction to Cr from said slag prevents said temperature of the molten steel from increasing.

* * * * *